US011274493B2

(12) United States Patent
Craig

(10) Patent No.: US 11,274,493 B2
(45) Date of Patent: Mar. 15, 2022

(54) V-DOOR SAFETY GATE

(71) Applicant: Nabors Drilling Technologies USA, Inc., Houston, TX (US)

(72) Inventor: Gary W. Craig, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 354 days.

(21) Appl. No.: 16/383,042

(22) Filed: Apr. 12, 2019

(65) Prior Publication Data

US 2020/0325755 A1 Oct. 15, 2020

(51) Int. Cl.

| | |
|---|---|
| ***E06B 11/02*** | (2006.01) |
| ***E05B 65/00*** | (2006.01) |
| *E06B 3/34* | (2006.01) |

(52) U.S. Cl.

CPC ..... *E06B 11/02* (2013.01); *E05B 65/0007* (2013.01); *E06B 11/022* (2013.01); *E06B 2003/343* (2013.01)

(58) Field of Classification Search

CPC ..... E21B 41/00; E06B 7/28; E06B 11/022; E06B 11/02; E06B 2003/343; E05B 65/0007; E05C 17/12; E05D 15/264; E05D 15/26

See application file for complete search history.

(56) References Cited

U.S. PATENT DOCUMENTS 1,160,198 A * 11/1915 Phillips ..... E05D 15/26 160/199
4,699,197 A * 10/1987 Hamrick ..... E05F 15/605 160/188
7,296,608 B2 * 11/2007 Weishar ..... E05D 15/54 160/200
8,840,352 B2 9/2014 Taggart et al.
9,085,926 B2 * 7/2015 Collinson ..... E05F 15/605
10,415,301 B2 * 9/2019 Kuan ..... E05C 1/065
2005/0028946 A1 * 2/2005 Weishar ..... E05F 15/643 160/214
2005/0236157 A1 10/2005 Logan
2008/0216408 A1 * 9/2008 Letkeman ..... E05F 15/605 49/340
2013/0042531 A1 * 2/2013 Hird, Jr. ..... E05F 15/627 49/246

(Continued)

OTHER PUBLICATIONS

"Fatal Fall Through "V" Door Onboard Offshore Platform—Investigation Report" published Aug. 26, 2013 https://officerofthewatch.com/2013/08/26/fatal-fall-through-v-door-onboard-offshore-platform-investigation-report/ (Year: 2013).*

(Continued)

*Primary Examiner* — Justin B Rephann
(74) *Attorney, Agent, or Firm* — Abel Schillinger, LLP; Enrique Abarca

(57) ABSTRACT

A gate assembly that can include a frame with first and second mounts to mount the gate assembly across a V-door space on a rig floor, a first gate rotationally attached to a left side of the frame, and a second gate rotationally attached to a right side of the frame, such that the first and second gates selectively permit and prevent access through the V-door space. Inner panels of the first and second gates can be configured to automatically open and close in response to a catwalk extending into the V-door space or retracting from the V-door space.

20 Claims, 9 Drawing Sheets

(56) References Cited

U.S. PATENT DOCUMENTS

2014/0259939 A1* 9/2014 Collinson ..... E05D 15/264
49/340
2017/0350185 A1* 12/2017 Kuan ..... E05B 65/06

OTHER PUBLICATIONS

PS Industries, "Paired Safety Gate_PS Safety Acess", published on 2019, pp. 1-3, Jul. 22, 2019.

* cited by examiner

V-DOOR SAFETY GATE

BACKGROUND

Embodiments of the present disclosure relate generally to the field of drilling and processing of wells. More particularly, present embodiments relate to a system and method for controlling access through a V-door space on a rig floor of a drilling rig during subterranean operations.

In the front of a drilling rig (or derrick) is a space that allows for tubulars and tools to be hoisted up from the ground and suspended in the drilling rig. The open front of the drilling rig can be referred to as a V-door. The rig floor can have safety fencing around a perimeter of the rig floor to improve safety for personnel working on the rig floor. However, the safety fencing generally has a gap in it where the pipe and tools are hoisted through the V-door. The gap in the safety fencing can be referred to as a V-door space which is open during movement of pipe or tools through the V-door space. Some drilling rigs may have posts on either side of the V-door space to mount a swing gate that is manually opened and closed to restrict or allow movement of the tubulars and tools through the V-door space. For example, when a tubular is being hoisted to the rig floor, the swing gate would need to be open to allow movement of the tubular through the V-door space. The personnel may manually open the swing gate to permit access through the V-door, and manually close the swing gate to prevent access through the V-door. However, manually opening or closing the swing gate can expose the personnel to potential dangers of falling from the rig floor through the V-door space. Therefore, improvements in drilling rig system are continually needed.

SUMMARY

One general aspect is a gate assembly that includes: a frame with first and second mounts configured to mount the gate assembly across a v-door space on a rig floor; a first gate rotationally attached to a left side of the frame; and a second gate rotationally attached to a right side of the frame, such that the first and second gates selectively permit and prevent access through the v-door space.

Embodiment may include one or more of the following features. The gate assembly where the first mount is attached to a first v-door post, the first v-door post being positioned on a left side of the v-door space, and where the second mount is attached to a second v-door post, the second v-door post being positioned on a right side of the v-door space. The gate assembly where the first gate includes a first inner panel rotationally attached to a first outer panel, where the second gate includes a second inner panel rotationally attached to a second outer panel, where the first outer panel is rotationally attached to a left side of the frame and the second outer panel is rotationally attached to a right side of the frame.

One general aspect is a method that can includes installing a gate assembly across a v-door space on a rig floor, the gate assembly including first and second gates; extending a catwalk through the v-door space; and rotating a portion of each of the first and second gates from a closed position to an open position in response to contact of the catwalk with the first gate portion and the second gate portion as the catwalk enters the v-door space.

Embodiment may include one or more of the following features. The method further including permitting access of the catwalk through the v-door space in response to the rotating of the first gate portion and the second gate portion. The method further including rotating the first gate portion and the second gate portion from the open position to the closed position in response to retracting the catwalk from the v-door space. The method where the gate assembly includes a frame with left and right vertical supports and a horizontal kick plate, and where the installing the gate assembly further includes: mounting the left vertical support to a left v-door post that is on a left side of the v-door space; mounting the right vertical support to a right v-door post that is on a right side of the v-door space; rotationally mounting the first gate to the left vertical support; rotationally mounting the second gate to the right vertical support; and rotating the first and second gates away from the horizontal kick plate, thereby allowing full access through the v-door space for transporting various equipment through the v-door space.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide an enhanced safety environment for operators working on a rig floor and around the V-door space where tubulars and tools are hoisted onto the drilling rig through the V-door space. The aspects of various embodiments are described in more detail below.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
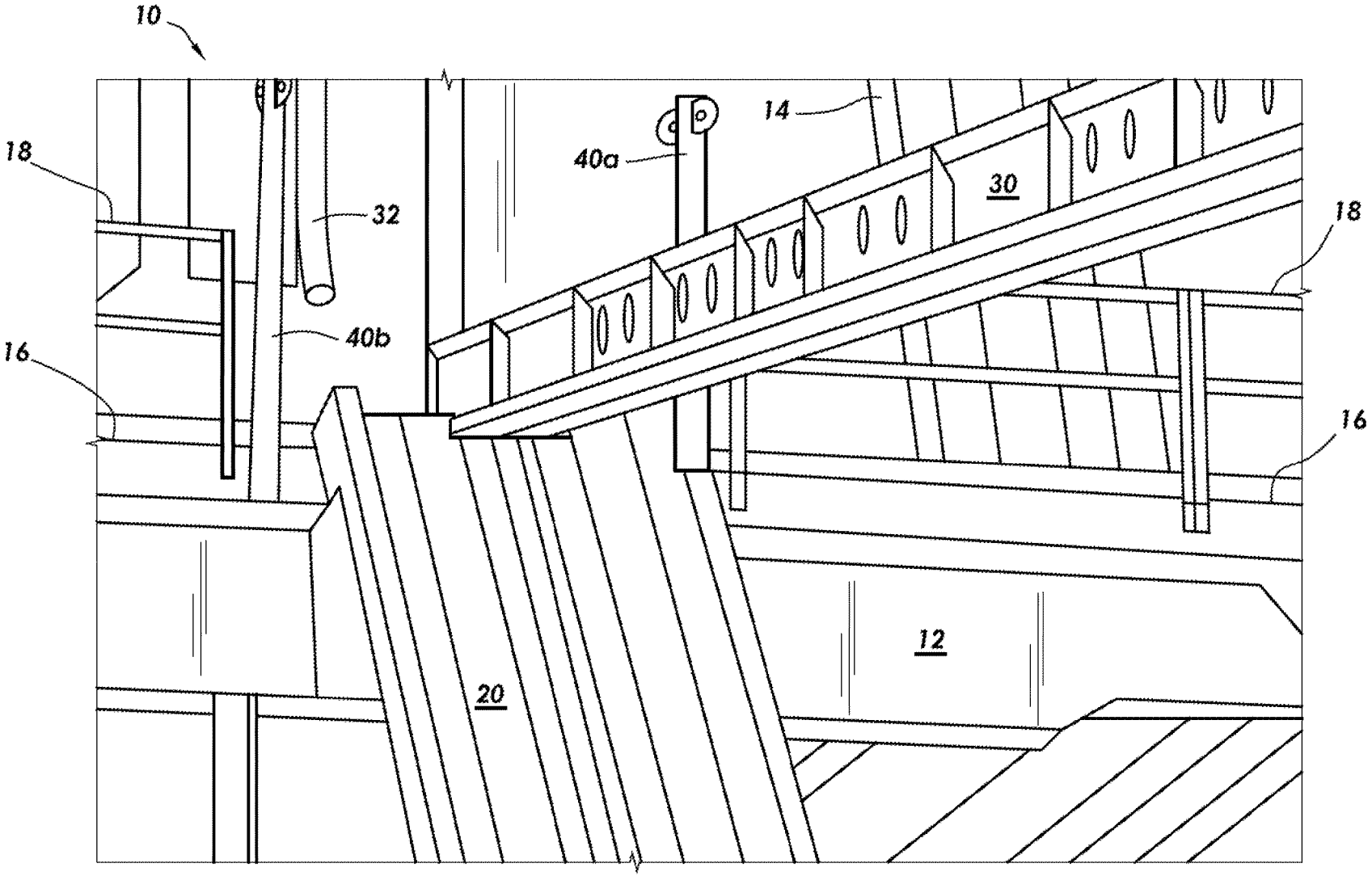
FIG. 1 (PRIOR ART)
FIG. 1 is a representative perspective view of a rig being utilized for a subterranean operation (e.g. drilling a wellbore) with a catwalk extending through a V-door space at the rig floor.

FIG. 1 is a representative perspective view of a drilling rig 10 being utilized for a subterranean operation, such as drilling a wellbore. The drilling rig 10 can include a substructure 12 that supports the derrick 14 and the rig floor 16. A drilling operation can require tripping a tubular string into and out a wellbore as the wellbore is being drilled or completed, or when fluids are being produced from the wellbore. Rig operations can also require hoisting tools between the ground and the rig floor to support various subterranean operations, such as casing tubulars and cementing heads, as well as other equipment that is transported through the full V-door space. Tubulars 32 can be stored in a horizontal storage area (not shown) that may be near ground level. A catwalk 30 can pick up tubulars 32 from the horizontal storage area, lift the tubulars 32 to the rig floor 16, hand off the tubulars 32 to pipe handling equipment which can manipulate the tubulars 32 as needed to support the subterranean operation. The catwalk 30 can be pulled up the V-door ramp 20 along groove 22 by pull cables 24. As the catwalk 30 reaches the top of the V-door ramp 20, the catwalk 30 can extend through the V-door space 48 which is generally aligned with the V-door ramp 20. The V-door posts 40*a*, 40*b* are positioned on either side of the V-door space 48 and define the V-door space 48 as being a portion of a perimeter of the rig floor 16. A personnel safety fence 18 can extend around the perimeter of the rig floor 16 as needed to protect rig floor operators from stepping off the rig floor 16. In this configuration, the safety fence 18 extends in both directions from the V-door space 48, leaving the V-door space open for extending and retracting the catwalk, and other equipment to be transported through the V-door space 48. The current disclosure provides enhanced personnel safety at the V-door space by providing a gate assembly that spans the V-door space as described in more detail below.

Figure 2:
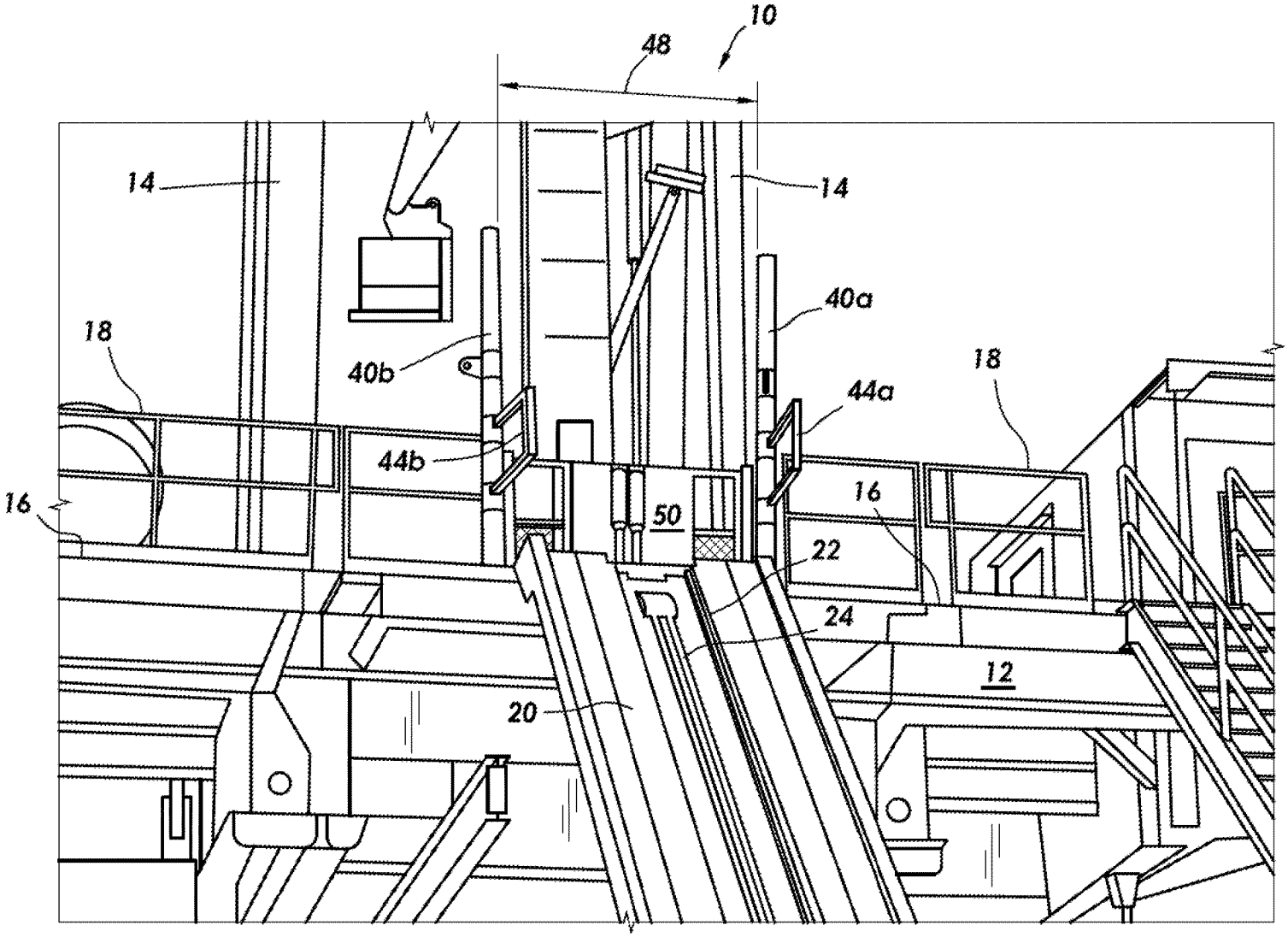
FIG. 2 is a representative perspective view of a gate assembly used to control access through the V-door space at the rig floor, in accordance with certain embodiments.

FIG. 2 is a representative perspective view of a gate assembly 50 used to control access through the V-door space at the rig floor. The gate assembly 50 can be attached (removably or otherwise) to the left and right V-door posts 40*a*, 40*b*. Left and right are used herein to refer to items of the drilling rig 10 or gate assembly 50 that are to the left or right of center of the V-door space 48 as viewed from the rig floor 16 side of the gate assembly 50. The left and right V-door posts 40*a*, 40*b* can include left and right manual safety gates 44*a*, 44*b* rotationally mounted to the respective left and right V-door posts 40*a*, 40*b*. These manual safety gates 44*a*, 44*b* can be rotated away from the rig floor 16 to an open position as shown in FIG. 2 to prevent interference of the manual safety gates 44*a*, 44*b* with operation of transporting equipment through the gate assembly 50. As stated above, a V-door ramp 20 can be attached to the rig floor 16 at the V-door space 48. A catwalk 30 can be pulled up the V-door ramp 22 by cables 24. As the catwalk 30 extends into the V-door space to deliver a tubular 32 to the rig floor 16, the gate assembly 50 can rotate inner portions of the gate assembly 50 inwardly toward the rig floor (or away from the V-door ramp) to allow access of the catwalk 30 through the gate assembly 50. When the catwalk 30 is retracted from the V-door space 48, the inner portions of the gate assembly 50 can automatically rotate back to a closed position, where the closed position is shown in FIG. 2.

Figure 3:
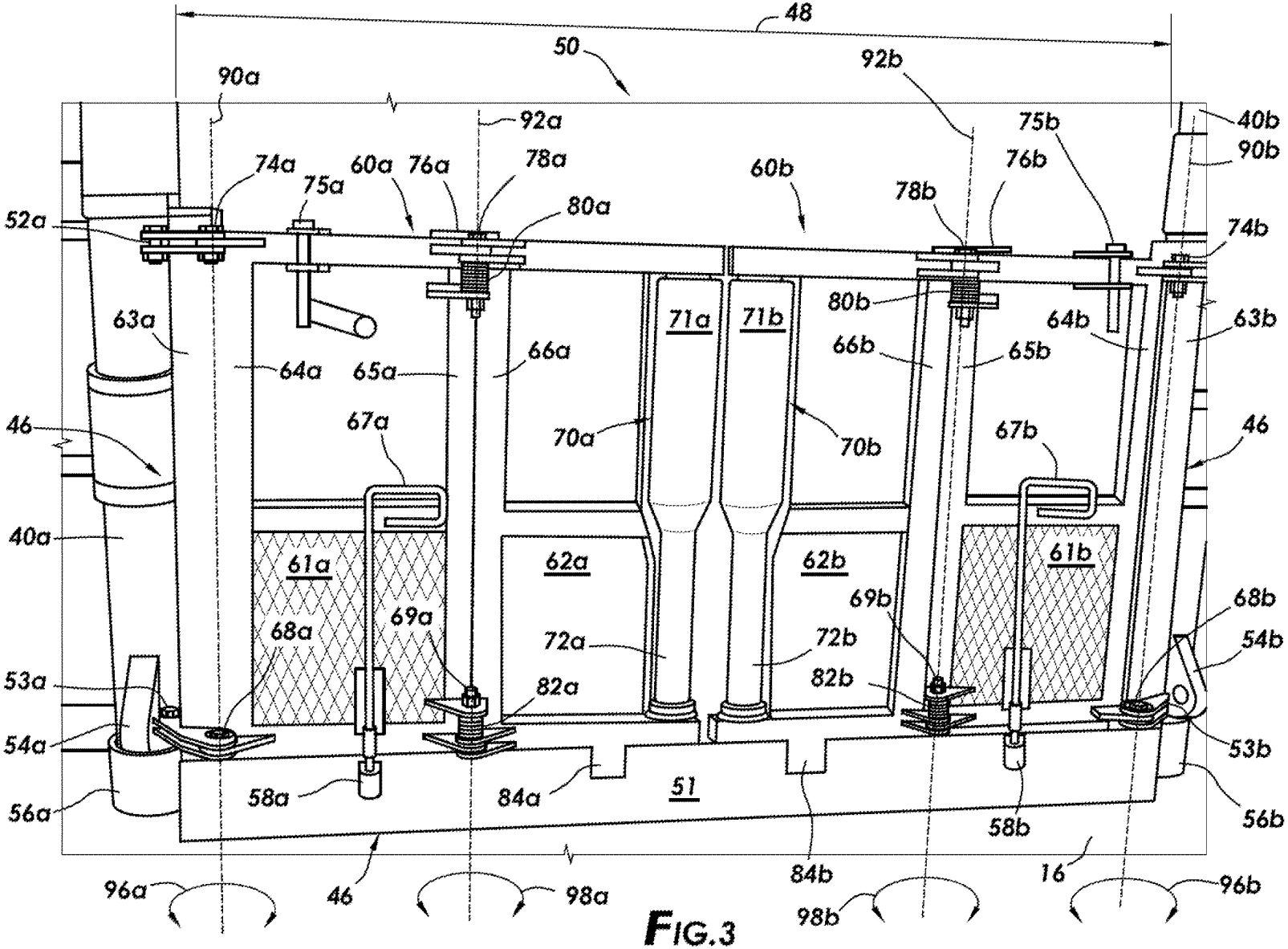
FIG. 3 is a representative front view of the V-door gate assembly with left and right gates of the gate assembly in a closed position, in accordance with certain embodiments.

FIG. 3 is a representative front view of the V-door gate assembly as viewed from the rig floor 16 with left and right gates 60*a*, 60*b* of the gate assembly 50 in a closed position. In general, reference numerals in the drawings that have a suffix of "a" indicate that the item in the drawing is to the left of the center of the V-door space 48 as viewed from the rig floor 16 side, and reference numerals in the drawings that have a suffix of "b" indicate that the item in the drawing is to the right of the center of the V-door space 48 as viewed from the rig floor 16 side. For example, 60*a* indicates a left gate and 60*b* indicates a right gate.

The gate assembly 50 can include a frame 46 that is used to secure the gate assembly 50 to the V-door posts 40*a*, 40*b*. The frame 46 can include a left vertical support 63*a*, a right vertical support 63*b*, and a kick plate 51. The kick plate 51 is positioned at the bottom of the gate assembly 50 and along the rig floor 16. Two mounts 52*a*, 53*a* can be used to attach the left vertical support 63*a* to the left V-door post 40*a*. Also, two mounts 52*b*, 53*b* can be used to attach the right vertical support 63*b* to the right V-door post 40*b*. Each mount 52*a*, 52*b*, 53*a*, 53*b*, can include two portions that can be removably attached to each other by a fastener (e.g. nut and bolt fastener, pin fastener, etc.) forming a rotatable hinge for the gate assembly. A first portion of each mount 52*a*, 52*b*, 53*a*, 53*b* can be rigidly attached (e.g. welding, etc.) to the gate assembly 50 at one of its vertical supports 63*a*, 63*b*, with a second portion of each mount 52*a*, 52*b*, 53*a*, 53*b* rotatably attached to the respective first portion using the fastener.

The second portion of each mount 52*a*, 52*b*, 53*a*, 53*b* can be rigidly attached (e.g. welding, etc.) to the respective V-door post 40*a*, 40*b*. When the second portion of each mount 52*a*, 52*b*, 53*a*, 53*b* is rigidly secured to the respective V-door post 40*a*, 40*b*, the mounts 52*a*, 52*b*, 53*a*, 53*b* can no longer rotate about the fastener, since both portions of the mounts 52*a*, 52*b*, 53*a*, 53*b* are rigidly attached to either the gate assembly 50 or a respective V-door post 40*a*, 40*b*. Allowing rotation between the first and second portions of the mounts 52*a*, 52*b*, 53*a*, 53*b* can be advantageous during installation of the gate assembly 50 across the V-door space 48. The gate assembly 50 can first be stood erect across the V-door space 48 prior to attachment to the V-door posts 40*a*, 40*b* and the rotatable mounts 52*a*, 52*b*, 53*a*, 53*b* can allow for adjustments to align the second portion of each mount 52*a*, 52*b*, 53*a*, 53*b* to the V-door posts 40*a*, 40*b*. The second portions of the mounts 52*a*, 52*b*, 53*a*, 53*b* can then be rigidly attached to the respective V-door post 40*a*, 40*b* to secure the gate assembly 50 in the V-door space 48.

However, it should be understood that the second portions of the mounts 52*a*, 52*b*, 53*a*, 53*b* can be rigidly attached to the respective V-door post 40*a*, 40*b* prior to being removably attached to the first portions of the mounts 52*a*, 52*b*, 53*a*, 53*b*, that are rigidly attached to the gate assembly 50.

The V-door post 40*a*, 40*b* are generally inserted into sockets 56*a*, 56*b* that are attached to the rig floor 16 when the drilling rig 10 is assembled. Each V-door post 40*a*, 40*b* can have a pad eye 54*a*, 54*b* positioned on the respective V-door post 40*a*, 40*b* just above the sockets 56*a*, 56*b*. The second portions of the bottom mounts 53*a*, 53*b* can be positioned adjacent the pad eyes 54*a*, 54*b*.

The left and right gates 60*a*, 60*b* can be rotationally attached to respective vertical supports 63*a*, 63*b* by respective fasteners 68*a*, 68*b*, 74*a*, 74*b* that allow the gates 60*a*, 60*b* to rotate relative to the frame 46 about axes 90*a*, 90*b*. Each gate 60*a*, 60*b* includes a respective outer panel 61*a*, 61*b* and a respective inner panel 62*a*, 62*b*. The outer panel 61*a*, 61*b* is rotationally attached to the respective vertical support 63*a*, 63*b*. The inner panel 62*a*, 62*b* is rotationally attached to the respective outer panel 61*a*, 61*b* at the respective axis of rotation 92*a*, 92*b* by fasteners 69*a*, 69*b*, 78*a*, 78*b*. Biasing devices 80*a*, 80*b*, 82*a*, 82*b* can be installed about respective fasteners 69*a*, 69*b*, 78*a*, 78*b* which can urge the inner panel 62*a*, 62*b* to be in line (or parallel) to the respective outer panel 61*a*, 61*b*. The biasing devices 80*a*, 80*b*, 82*a*, 82*b* can be pre-loaded with a predetermined torsion force that will close the inner panel 62*a*, 62*b* when an opposing force acting against the torsion force is less than the torsion force.

The left outer panel 61*a* can include left vertical supports 64*a*, 65*a*. The left inner panel 62*a* can include a left vertical support 66*a*. The left vertical support 64*a* can be rotationally attached to the left vertical support 63*a* by fasteners 68*a*, 74*a*. The left vertical support 66*a* can be rotationally attached to the left vertical support 65*a* by fasteners 69*a*, 78*a*. When the gate assembly 50 is closed, the left vertical support 64*a* can abut the vertical support 63*a* to prevent further rotation of the gate 60*a*, and the left vertical support 66*a* can abut the vertical support 65*a* to prevent further rotation of the left inner panel 62*a* with respect to the left outer panel 62*a*.

The right outer panel 61*b* can include right vertical supports 64*b*, 65*b*. The right inner panel 62*b* can include a right vertical support 66*b*. The right vertical support 64*b* can be rotationally attached to the right vertical support 63*b* by fasteners 68*b*, 74*b*. The right vertical support 66*b* can be rotationally attached to the right vertical support 65*b* by fasteners 69*b*, 78*b*. When the gate assembly 50 is closed, the right vertical support 64*b* can abut the vertical support 63*b* to prevent further rotation of the gate 60*b*, and the right vertical support 66*b* can abut the vertical support 65*b* to prevent further rotation of the right inner panel 62*b* with respect to the right outer panel 62*b*.

A roller 70*a*, 70*b* is rotationally attached to a side of the respective inner panel 62*a*, 62*b* that is opposite the side that is rotationally attached to the respective outer panel 61*a*, 61*b*. The rollers 70*a*, 70*b* are adjacent each other when the gate assembly 50 is closed. The rollers 70*a*, 70*b* prevent the end of the catwalk 30 from catching a portion of the gate assembly 50 and damaging the gate assembly 50. The rollers 70*a*, 70*b* each have an enlarged diameter portion 71*a*, 71*b* at the top of the roller 70*a*, 70*b*, with a reduced diameter portion 72*a*, 72*b* at the bottom of the roller 70*a*, 70*b*. A transition portion 73*a*, 73*b* transitions between the enlarged diameter portion 71*a*, 71*b* to the reduced diameter portion 72*a*, 72*b* for each roller 70*a*, 70*b*. The enlarged diameter portion 71*a*, 71*b* can engage a catwalk 30 when the catwalk is being extended through the gate assembly 50. The reduced diameter portion 72*a*, 72*b* provides additional clearance between the rollers 70*a*, 70*b* and the catwalk 30 to allow more clearance for lower parts of the catwalk 30 that may protrude from a side of the catwalk 30 at a greater distance than the upper portion of the catwalk 30, for example side rollers 32 (see FIG. 4) on each side of the catwalk 30. The rollers 32 can be used to allow the front of the catwalk 30 to travel up the V-door guide 22 of the V-door ramp 20. The sides of the inner panels 62*a*, 62*b* adjacent the rollers 70*a*, 70*b* can be formed to follow the varied diameter profile of the rollers 70*a*, 70*b*. Minimizing a gap between the inner panels 62*a*, 62*b* and the rollers 70*a*, 70*b* can help prevent the end of the catwalk 30 improperly engaging the rollers 70*a*, 70*b* and possibly causing damage to the gate assembly 50.

The outer panels 61*a*, 61*b* can include a latch 67*a*, 67*b* that can be manually actuated to engage a socket 58*a*, 58*b* on the kick plate 51. When the left latch 67*a* is inserted into the left socket 58*a*, then the left outer panel 61*a* is prevented from rotating away from the kick plate 51. The left inner panel 62*a* is still allowed to rotate away from the kick plate if a force larger than the combined pre-loaded torsion forces of the left biasing devices 80*a* and 82*a* is applied to the left inner panel 62*a*. When this larger force (such as a catwalk 30 extending through the gate assembly 50) is applied to the left inner panel 62*a*, the left inner panel 62*a* can rotate to at least 90 degrees+/−15 degrees relative to the left outer panel 61*a* to provide clearance for the extending catwalk 30. Since the left outer panel 61*a* is engaged with the kick plate 51 through engagement of the left latch 67*a* with the left socket 58*a*, the left outer panel 61*a* is in line (or substantially parallel) to the kick plate 51, and therefore, the left inner panel 62*a* can rotate to at least 90 degrees+/−15 degrees relative to the kick plate 51, when the left latch 67*a* is engaged with the left socket 58*a*. When the force applied to the left inner panel 62*a* is reduced to be less than the combined pre-loaded torsion forces of the left biasing devices 80*a* and 82*a*, then the left inner panel 62*a* can rotate back to being in line (or substantially parallel) with the left outer panel 61*a* and the kick plate 51. The left stop 84*a* also prevents the left inner panel 62*a* from rotating past the kick plate 51.

When the right latch 67*b* is inserted into the right socket 58*b*, then the right outer panel 61*b* is prevented from rotating away from the kick plate 51. The right inner panel 62*b* is still allowed to rotate away from the kick plate if a force larger than the combined pre-loaded torsion forces of the right biasing devices 80*b* and 82*b* is applied to the right inner panel 62*b*. When this larger force (such as a catwalk 30 extending through the gate assembly 50) is applied to the right inner panel 62*b*, the right inner panel 62*b* can rotate to at least 90 degrees+/−15 degrees relative to the right outer panel 61*b* to provide clearance for the extending catwalk 30. Since the right outer panel 61*b* is engaged with the kick plate 51 through engagement of the right latch 67*b* with the right socket 58*b*, the right outer panel 61*b* is in line (or substantially parallel) to the kick plate 51, and therefore, the right inner panel 62*b* can rotate to at least 90 degrees+/−15 degrees relative to the kick plate 51, when the right latch 67*b* is engaged with the right socket 58*b*. When the force applied to the right inner panel 62*b* is reduced to be less than the combined pre-loaded torsion forces of the right biasing devices 80*b* and 82*b*, then the right inner panel 62*b* can rotate back to being in line (or substantially parallel) with the right outer panel 61*b* and the kick plate 51. The right stop 84*b* also prevents the right inner panel 62*b* from rotating past the kick plate 51.

Figure 4:
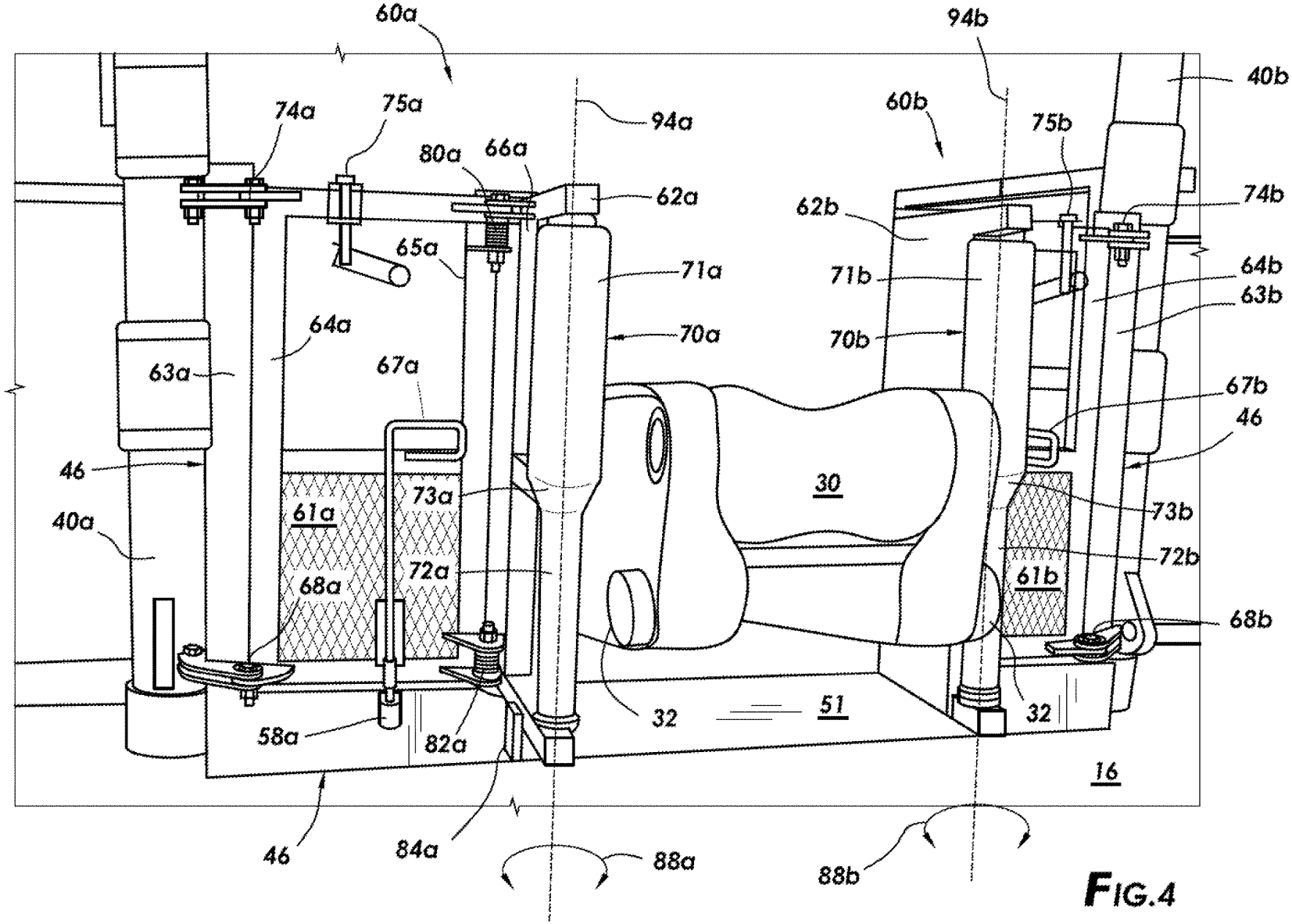
FIG. 4 is a representative front view of the V-door gate assembly with a catwalk extended through the gate assembly, in accordance with certain embodiments.

FIG. 4 is a representative front view of the V-door gate assembly 50 with a catwalk 30 extended through the gate assembly 50. As the catwalk 30 extends into the V-door space 48 and engages the inner panels 62*a*, 62*b*, the inner panels 62*a*, 62*b* can be rotated inwardly (away from the V-ramp 20) as shown. The rollers 70*a*, 70*b* rotate (arrows 88*a*, 88*b*) about the respective rotational axes 94*a*, 94*b* and roll against the catwalk 30 as the catwalk 30 extends further into the V-door space 48. The enlarged diameter portions 71*a*, 71*b* engage the upper portion of the catwalk 30, while the reduced diameter portions 72*a*, 72*b* provide additional clearance between the roller 70*a*, 70*b* so not to engage the rollers 32 on each side of the catwalk 30. Because the latches 67*a*, 67*b* are engaged with the respective sockets 58*a*, 58*b*, the outer panels 61*a*, 61*b* are rotationally fixed to the kick plate 51, but the inner panels 62*a*, 62*b* rotate to allow the catwalk 30 through the V-door gate assembly 50.

Figure 5:
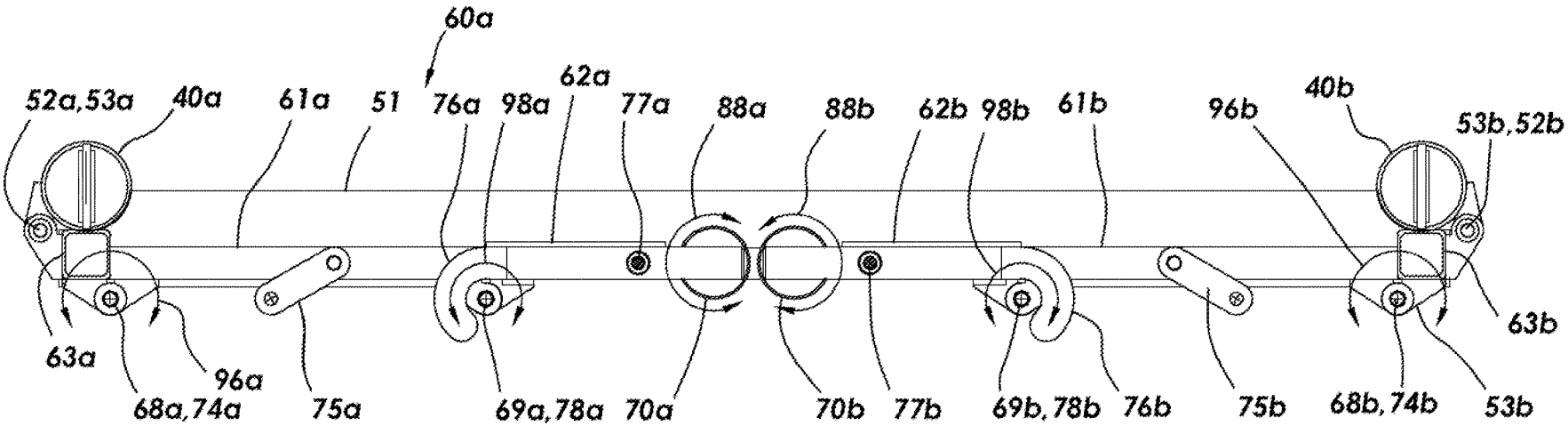
FIG. 5 is a representative top view of the V-door gate assembly with left and right gates in a closed position, in accordance with certain embodiments.

FIG. 5 is a representative top view of the V-door gate assembly 50 with the gates 60*a*, 60*b* in a closed position. In the closed position, the gates 60*a*, 60*b* are substantially in line with the kick plate 51. Therefore, the inner panels 62*a*, 62*b* and outer panels 61*a*, 61*b* are also substantially in line with the kick plate 51 in the closed position. The inner panels 62*a*, 62*b* can rotate about respective axes 92*a*, 92*b* relative to the outer panels 61*a*, 61*b* from the closed position shown in FIG. 5 to an open position, as one shown in FIG. 6. The inner panels 62*a*, 62*b* can be rotated away from the closed position either manually or automatically. The outer panels 61*a*, 61*b* can rotate about respective axes 90*a*, 90*b* relative to the frame 46, when the latches 67*a*, 67*b* are disengaged from the respective sockets 58*a*, 58*b*.

Figure 6:
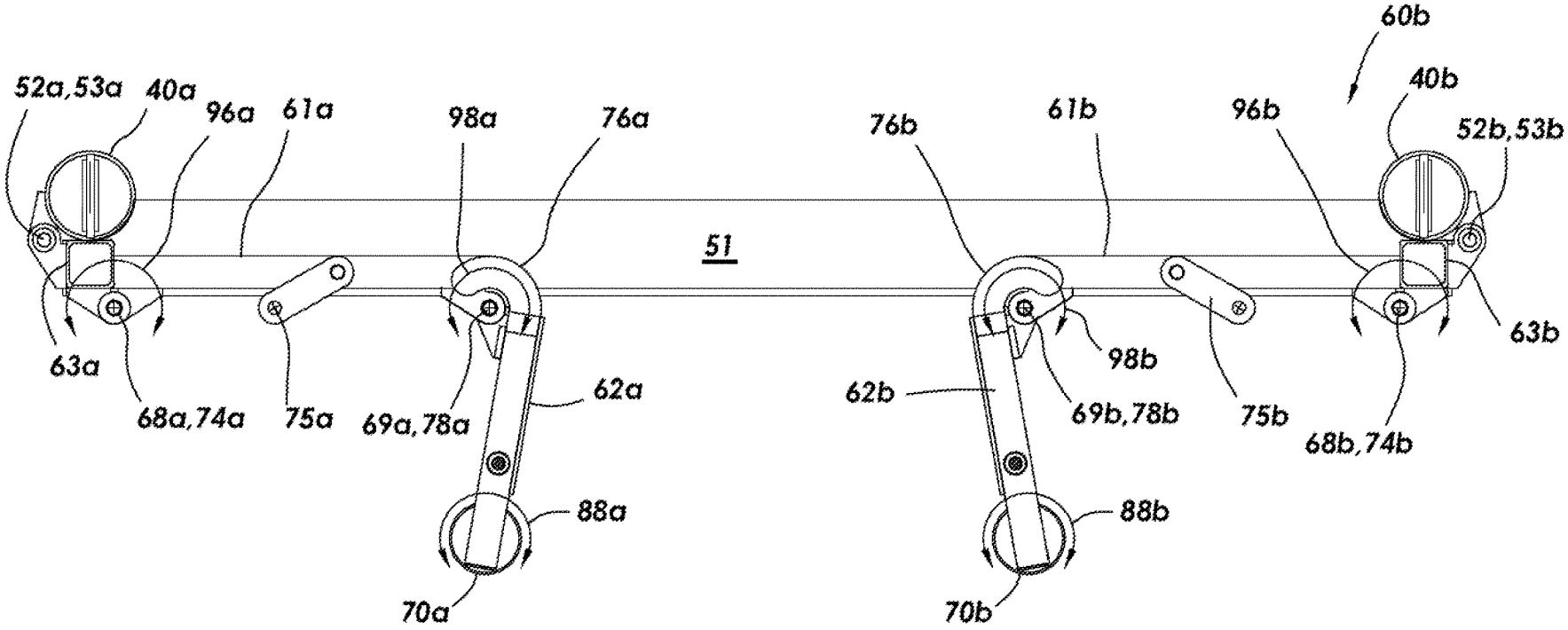
FIG. 6 is a representative top view of the V-door gate assembly with inner panels of the left and right gates in an open position and outer panels of the left and right gates in a closed position, in accordance with certain embodiments.
Figure 7:
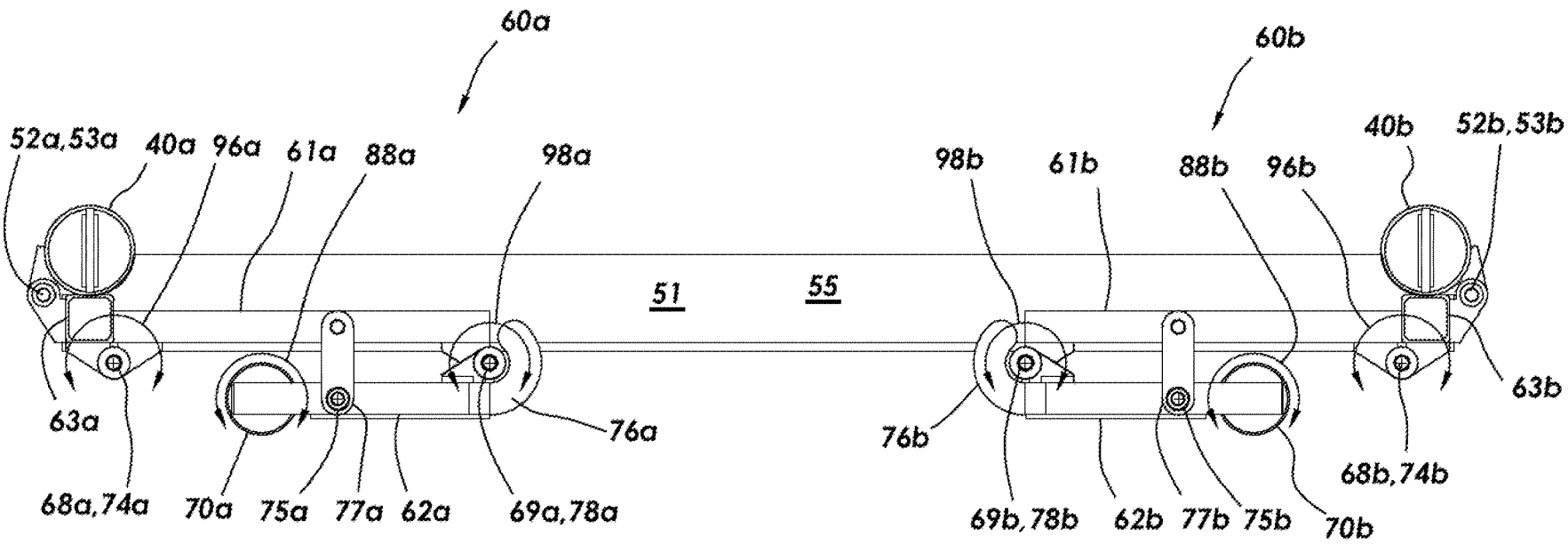
FIG. 7 is a representative top view of the V-door gate assembly with inner panels of the left and right gates in an locked open position and outer panels of the left and right gates in a closed position, in accordance with certain embodiments.

FIG. 6 is a representative top view of the V-door gate assembly 50 with inner panels 62*a*, 62*b* of the gates 60*a*, 60*b* in an open position and outer panels 61*a*, 61*b* of the gates 60*a*, 60*b* in a closed position. In this configuration, the latches 67*a*, 67*b* are engaged with the respective sockets 58*a*, 58*b* preventing rotation of the outer panels 61*a*, 61*b* relative to the frame 46 (or kick plate 51). A catwalk 30 (not shown) can apply an opening force to the inner panels 62*a*, 62*b* causing them to rotate from a closed position (as shown in FIG. 5) to the open position shown in FIG. 6. When the opening force is removed (e.g. when the catwalk 30 is retracted from the V-door space 48), the inner panels 62*a*, 62*b* will automatically rotate back to the closed position due to the biasing devices 80*a*, 80*b*, 82*a*, 82*b*. Finger guards 76*a*, 76*b* are installed on the top of the inner panels 62*a*, 62*b* to enhance operator safety. The finger guards 76*a*, 76*b* are curved to maintain an overlap on a portion of the top of the outer panels 61*a*, 61*b* as the inner panels 62*a*, 62*b* are rotated from closed to open positions, where the open positions are approximately 90 degrees+/−15 degrees relative to the outer panels 61*a*, 61*b*. The finger guards 76*a*, 76*b* may not necessarily overlap the portion of the top of the outer panels 61*a*, 61*b* when the gates 60*a*, 60*b* are rotated to a "folded" configuration as shown in FIG. 7. However, during operation where the catwalk 30 enters and exits the V-door space 48, the finger guards 76*a*, 76*b* can help prevent operators fingers from being inadvertently positioned between the inner panels 62*a*, 62*b* and the outer panels 61*a*, 61*b*.

FIG. 7 is a representative top view of the V-door gate assembly 50 with inner panels 62*a*, 62*b* locked in an open position and outer panels 61*a*, 61*b* in a closed position. Sometimes it is beneficial to lock the inner panels 62*a*, 62*b* in an open position before rotating the outer panels 61*a*, 61*b* to an open position because this "folded" configuration requires less clearance on the rig floor 16 to open the outer panels 61*a*, 61*b* when a full opening of the gate assembly is required to allow larger equipment than a catwalk 30 to pass through the V-door space 48. This can be particularly useful when vertical tubular storage (or other equipment or structures) is in close proximity to the gate assembly 50 on the rig floor 16. To lock the inner panels 62*a*, 62*b* in the "folded" configuration, the inner panels 62*a*, 62*b* are rotated almost 180 degrees to align next to the outer panels 61*a*, 61*b*. An operator can then align the sockets 77*a*, 77*b* on the top of each inner panel 62*a*, 62*b* with the retention features 75*a*, 75*b*. Each retention feature 75*a*, 75*b* includes a bracket fixed at one end to the respective outer panel 61*a*, 61*b* and a hole at the other end of the bracket for aligning with the socket 77*a*, 77*b*. When the hole of the retention feature 75*a*, 75*b* is aligned with the socket 77*a*, 77*b*, then a pin can be inserted through the hole in the bracket and into the socket 77*a*, 77*b*. This will rotationally fix the inner panel 62*a*, 62*b* to its respective outer panel 61*a*, 61*b* via the retention features 75*a*, 75*b*. Then the operator is free to rotate the folded gate 60*a*, 60*b* from the closed position to an open position by releasing the latches 67*a*, 67*b* and rotating the gates 60*a*, 60*b*, which are in a folded configuration.

Figure 8:
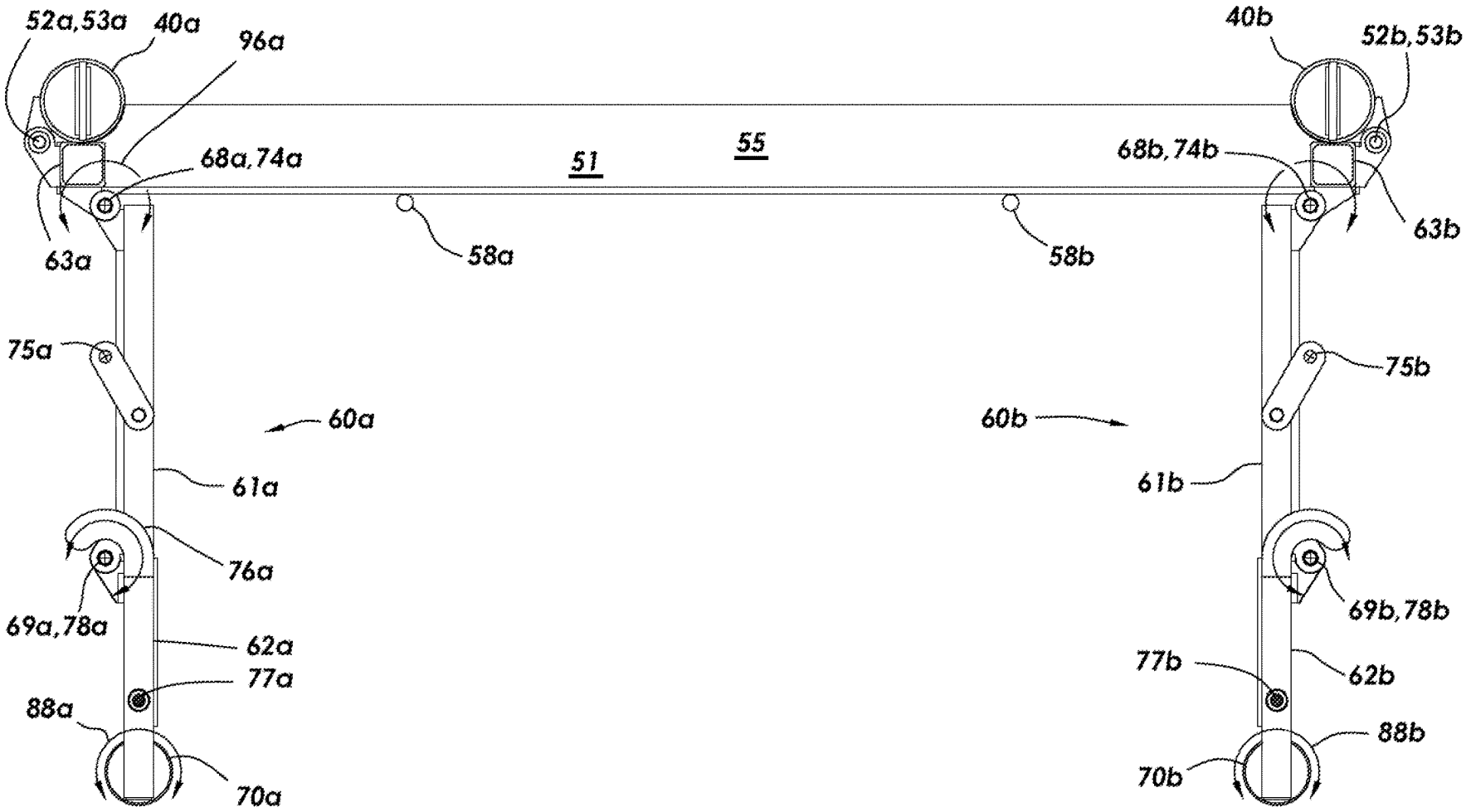
FIG. 8 is a representative top view of the V-door gate assembly with the left and right gates in an open position, in accordance with certain embodiments.

FIG. 8 is a representative top view of the V-door gate assembly 50 with the gates 60*a*, 60*b* in an open position. If reduced clearance is not needed, then the unfolded gates 60*a*, 60*b* can be opened as in FIG. 8 to provide full access through the V-door space 48. In this configuration, an operator can release the latches 67*a*, 67*b* to allow rotation of the outer panels 61*a*, 61*b* inwardly (i.e. away from the V-door ramp 20) from the kick plate 51. The biasing devices 80*a*, 80*b*, 82*a*, 82*b* will tend to keep the inner panels 62*a*, 62*b* in line with the outer panels 61*a*, 61*b* as the gates 60*a*, 60*b* are opened.

Figure 9:
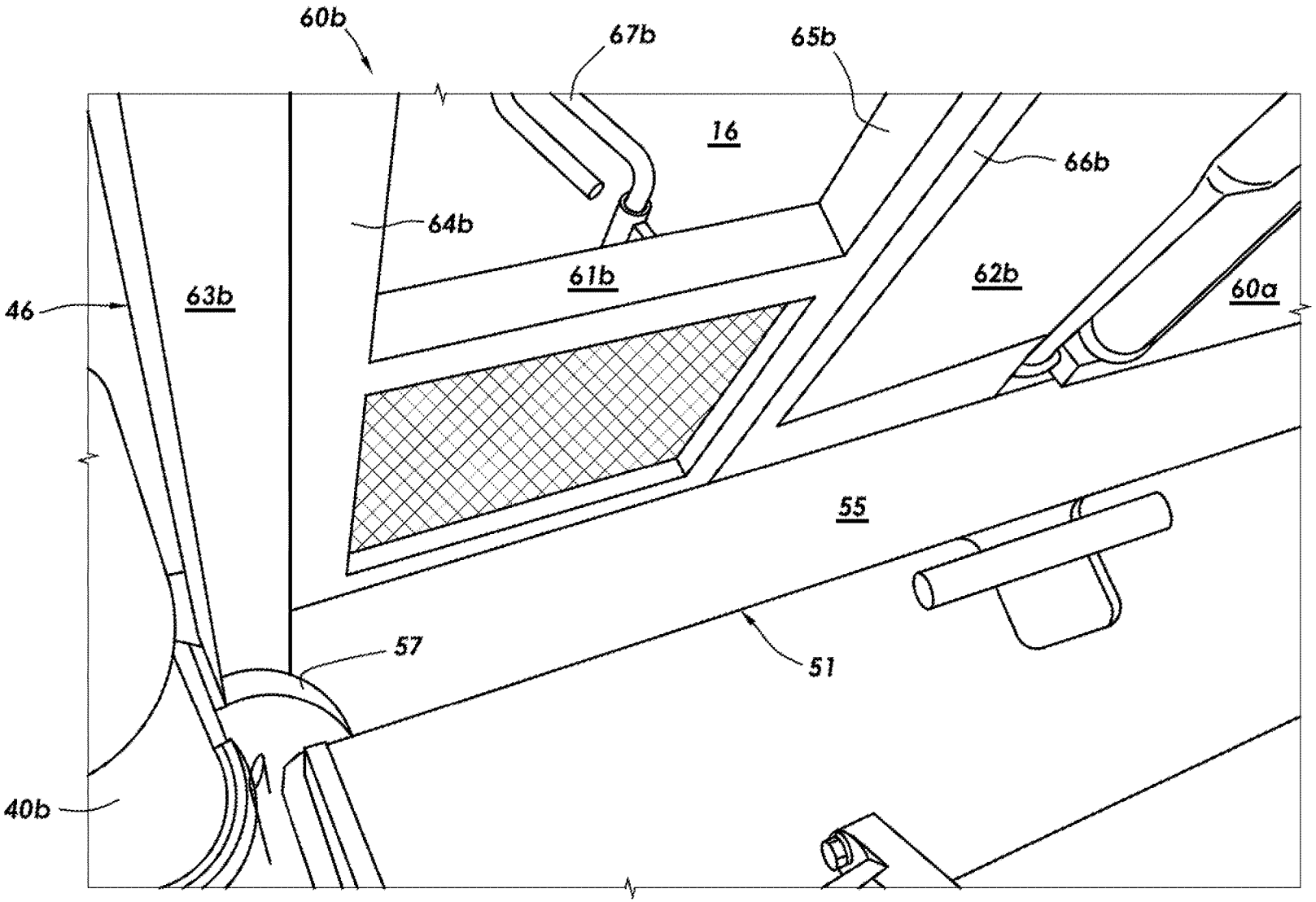
FIG. 9 is a representative perspective partial rear view of the V-door gate assembly that faces a V-door ramp, in accordance with certain embodiments.

FIG. 9 is a representative perspective partial rear view of the V-door gate assembly that may face a V-door ramp. The frame 46 of the gate assembly 50 can include an inclined surface 55 that can extend along a backside of the kick plate 51. The inclined surface 55 can provide a smooth transition between a lip at the edge of the rig floor and the bottom of the gate panels 61*a*, 61*b*, 62*a*, 62*b*. A scalloped corner 57 can be formed at each end of the inclined surface 55 to accommodate various configurations of V-door posts 40*a*, 40*b*.

EMBODIMENTS

Embodiment 1

A gate assembly comprising:

a frame with first and second mounts configured to mount the gate assembly across a V-door space on a rig floor;

a first gate rotationally attached to a left side of the frame; and a second gate rotationally attached to a right side of the frame, such that the first and second gates selectively permit and prevent access through the V-door space.

Embodiment 2

The gate assembly of embodiment 1, wherein the first mount is attached to a first V-door post, the first V-door post being positioned on a left side of the V-door space, and wherein the second mount is attached to a second V-door post, the second V-door post being positioned on a right side of the V-door space.

Embodiment 3

The gate assembly of embodiment 1, wherein the first gate comprises a first inner panel rotationally attached to a first outer panel, wherein the second gate comprises a second inner panel rotationally attached to a second outer panel, wherein the first outer panel is rotationally attached to a left side of the frame and the second outer panel is rotationally attached to a right side of the frame.

Embodiment 4

The gate assembly of embodiment 3, further comprising one or more first biasing devices which urge the first inner panel toward being in line with the first outer panel, and one or more second biasing devices which urge the second inner panel toward being in line with the second outer panel.

Embodiment 5

The gate assembly of embodiment 3, wherein the frame further comprises a kick plate positioned along a bottom of the gate assembly proximate the rig floor, wherein the first outer panel comprises a first latch and the second outer panel comprises a second latch, wherein the first latch rotationally fixes the first outer panel to the kick plate when the first latch is engaged with the kick plate, and wherein the second latch rotationally fixes the second outer panel to the kick plate when the second latch is engaged with the kick plate.

Embodiment 6

The gate assembly of embodiment 5, wherein, with the first and second latches disengaged from the kick plate, the first and second gates are configured to rotate away from the kick plate to allow full access through the V-door space for various equipment that is wider than a catwalk.

Embodiment 7

The gate assembly of embodiment 5, wherein, with the first and second latches engaged with the kick plate, the first and second inner panels are configured to rotate away from the kick plate to allow a catwalk to extend though the V-door space.

Embodiment 8

The gate assembly of embodiment 7, wherein the first and second inner panels are configured to rotate toward the kick plate to a closed position after the catwalk is retracted from the V-door space.

Embodiment 9

The gate assembly of embodiment 5, wherein the first inner panel comprises a first stop that engages the kick plate when the first inner panel is substantially parallel with the kick plate, and wherein the second inner panel comprises a second stop that engages the kick plate when the second inner panel is substantially parallel with the kick plate.

Embodiment 10

The gate assembly of embodiment 3, wherein the first gate comprises a first pinch point guard that is fixed to a top of the first outer panel and extends over a top portion of the first inner panel, the top portion being adjacent the first outer panel when the first inner panel is in line with the first outer panel, wherein the first pinch point guard extends in an arc over the top portion of the first inner panel as the top portion of the first inner panel moves between "0" degrees and "90" degrees+/−15 degrees, and wherein at "0" degrees the first inner panel is in line with the first outer panel, and at "90" degrees+/−15 degrees the first inner panel is substantially perpendicular to the first outer panel.

Embodiment 11

The gate assembly of embodiment 10, wherein the second gate comprises a second pinch point guard that is fixed to a top of the second outer panel and extends over a top portion of the second inner panel, the top portion being adjacent the second outer panel when the second inner panel is in line with the second outer panel, wherein the second pinch point guard extends in an arc over the top portion of the second inner panel as the top portion of the second inner panel moves between "0" degrees and "90" degrees+/−15 degrees, and wherein at "0" degrees the second inner panel is in line with the second outer panel, and at "90" degrees+/−15 degrees the second inner panel is substantially perpendicular to the second outer panel.

Embodiment 12

The gate assembly of embodiment 3, wherein one side of the first inner panel is rotationally attached to the first outer panel and a first roller is rotationally attached to an opposite side of the first inner panel, and wherein one side of the second inner panel is rotationally attached to the second outer panel and a second roller is rotationally attached to an opposite side of the second inner panel.

Embodiment 13

The gate assembly of embodiment 12, wherein the first and second rollers have a cylindrical top portion with a larger diameter than a diameter of a cylindrical bottom portion.

Embodiment 14

The gate assembly of embodiment 12, wherein the first and second rollers are configured to rotate when a catwalk is extended through the V-door space or retracted from the V-door space.

Embodiment 15

The gate assembly of embodiment 3, wherein the first outer panel comprises a first retention feature that is configured to retain the first inner panel in an open position when the first inner panel is rotated to the open position and the first retention feature engages the first inner panel, and wherein the second outer panel comprises a second retention feature that is configured to retain the second inner panel in an open position when the second inner panel is rotated to the open position and the second retention feature engages the second inner panel.

Embodiment 16

A method comprising:

installing a gate assembly across a V-door space on a rig floor, the gate assembly including first and second gates;

extending a catwalk through the V-door space; and rotating a portion of each of the first and second gates from a closed position to an open position in response to contact of the catwalk with the first gate portion and the second gate portion as the catwalk enters the V-door space.

Embodiment 17

The method of embodiment 16, further comprising permitting access of the catwalk through the V-door space in response to the rotating of the first gate portion and the second gate portion.

Embodiment 18

The method of embodiment 16, further comprising rotating the first gate portion and the second gate portion from the open position to the closed position in response to retracting the catwalk from the V-door space.

Embodiment 19

The method of embodiment 16, wherein the gate assembly comprises a frame with left and right vertical supports and a horizontal kick plate, and wherein the installing the gate assembly further comprises:

mounting the left vertical support to a left V-door post that is on a left side of the V-door space;

mounting the right vertical support to a right V-door post that is on a right side of the V-door space;

rotationally mounting the first gate to the left vertical support;

rotationally mounting the second gate to the right vertical support; and rotating the first and second gates away from the horizontal kick plate, thereby allowing full access through the V-door space for transporting various equipment through the V-door space.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. A gate assembly comprising:

a frame with first and second mounts configured to mount the gate assembly across a V-door space on a rig floor;

a first gate rotationally attached to a left side of the frame, the first gate comprising a first inner panel rotationally attached to a first outer panel; and a second gate rotationally attached to a right side of the frame, the second gate comprising a second inner panel rotationally attached to a second outer panel, wherein the first and second gates selectively permit and prevent access through the V-door space, wherein the first inner panel rotates independently of the first outer panel when the first outer panel is engaged with the frame, and wherein the second inner panel rotates independently of the second outer panel when the second outer panel is engaged with the frame.

2. The gate assembly of claim 1, wherein the first mount is attached to a first V-door post, the first V-door post being positioned on a left side of the V-door space, and wherein the second mount is attached to a second V-door post, the second V-door post being positioned on a right side of the V-door space.

3. The gate assembly of claim 1, wherein the first outer panel is rotationally attached to a left side of the frame and the second outer panel is rotationally attached to a right side of the frame.

4. The gate assembly of claim 3, further comprising one or more first biasing devices which urge the first inner panel toward being in line with the first outer panel, and one or more second biasing devices which urge the second inner panel toward being in line with the second outer panel.

5. The gate assembly of claim 3, wherein the first gate comprises a first pinch point guard that is fixed to a top of the first outer panel and extends over a top portion of the first inner panel, the top portion being adjacent the first outer panel when the first inner panel is in line with the first outer panel, wherein the first pinch point guard extends in an arc over the top portion of the first inner panel as the top portion of the first inner panel moves between "0" degrees and "90" degrees+/−15 degrees, and wherein at "0" degrees the first inner panel is in line with the first outer panel, and at "90" degrees+/−15 degrees the first inner panel is substantially perpendicular to the first outer panel.

6. The gate assembly of claim 5, wherein the second gate comprises a second pinch point guard that is fixed to a top of the second outer panel and extends over a top portion of the second inner panel, the top portion being adjacent the second outer panel when the second inner panel is in line with the second outer panel, wherein the second pinch point guard extends in an arc over the top portion of the second inner panel as the top portion of the second inner panel moves between "0" degrees and "90" degrees+/−15 degrees, and wherein at "0" degrees the second inner panel is in line with the second outer panel, and at "90" degrees+/−15 degrees the second inner panel is substantially perpendicular to the second outer panel.

7. The gate assembly of claim 3, wherein the first outer panel comprises a first retention feature that is configured to retain the first inner panel in an open position when the first inner panel is rotated to the open position and the first retention feature engages the first inner panel, and wherein the second outer panel comprises a second retention feature that is configured to retain the second inner panel in an open position when the second inner panel is rotated to the open position and the second retention feature engages the second inner panel.

8. The gate assembly of claim 1, wherein the first inner panel and the second inner panel are configured to rotate relative to the first outer panel and the second outer panel toward an open position when a catwalk engages the first inner panel and the second inner panel.

9. The gate assembly of claim 8, wherein the first inner panel and the second inner panel are configured to rotate relative to the first outer panel and the second outer panel to a closed position when the catwalk disengages the first inner panel and the second inner panel.

10. The gate assembly of claim 9, wherein a first biasing device urges the first inner panel to the closed position when the catwalk disengages from the first inner panel.

11. The gate assembly of claim 9, wherein a second biasing device urges the second inner panel to the closed position when the catwalk disengages from the second inner panel.

12. The gate assembly of claim 1, wherein a first biasing device urges the first inner panel to be inline with the first outer panel when the first outer panel is disengaged from the frame and while the first outer panel is rotated relative to the frame.

13. A gate assembly comprising:

a frame with first and second mounts configured to mount the gate assembly across a V-door space on a rig floor;

a first gate rotationally attached to a left side of the frame; and a second gate rotationally attached to a right side of the frame, such that the first and second gates selectively permit and prevent access through the V-door space, wherein the first gate comprises a first inner panel rotationally attached to a first outer panel, wherein the second gate comprises a second inner panel rotationally attached to a second outer panel, wherein the first outer panel is rotationally attached to a left side of the frame and the second outer panel is rotationally attached to a right side of the frame, wherein the frame further comprises a kick plate positioned along a bottom of the gate assembly proximate the rig floor, wherein the first outer panel comprises a first latch and the second outer panel comprises a second latch, wherein the first latch rotationally fixes the first outer panel to the kick plate when the first latch is engaged with the kick plate, and wherein the second latch rotationally fixes the second outer panel to the kick plate when the second latch is engaged with the kick plate.

14. The gate assembly of claim 13, wherein, with the first and second latches disengaged from the kick plate, the first and second gates are configured to rotate away from the kick plate to allow full access through the V-door space for various equipment that is wider than a catwalk.

15. The gate assembly of claim 13, wherein, with the first and second latches engaged with the kick plate, the first and second inner panels are configured to rotate away from the kick plate to allow a catwalk to extend though the V-door space.

16. The gate assembly of claim 15, wherein the first and second inner panels are configured to rotate toward the kick plate to a closed position after the catwalk is retracted from the V-door space.

17. The gate assembly of claim 13, wherein the first inner panel comprises a first stop that engages the kick plate when the first inner panel is substantially parallel with the kick plate, and wherein the second inner panel comprises a second stop that engages the kick plate when the second inner panel is substantially parallel with the kick plate.

18. A gate assembly comprising:

a frame with first and second mounts configured to mount the gate assembly across a V-door space on a rig floor;

a first gate rotationally attached to a left side of the frame; and a second gate rotationally attached to a right side of the frame, such that the first and second gates selectively permit and prevent access through the V-door space, wherein the first gate comprises a first inner panel rotationally attached to a first outer panel, wherein the second gate comprises a second inner panel rotationally attached to a second outer panel, wherein the first outer panel is rotationally attached to a left side of the frame and the second outer panel is rotationally attached to a right side of the frame, wherein one side of the first inner panel is rotationally attached to the first outer panel and a first roller is rotationally attached to an opposite side of the first inner panel, and wherein one side of the second inner panel is rotationally attached to the second outer panel and a second roller is rotationally attached to an opposite side of the second inner panel.

19. The gate assembly of claim 18, wherein the first and second rollers have a cylindrical top portion with a larger diameter than a diameter of a cylindrical bottom portion.

20. The gate assembly of claim 18, wherein the first and second rollers are configured to rotate when a catwalk is extended through the V-door space or retracted from the V-door space.

* * * * *